United States Patent [19]

Mallett

[11] Patent Number: 5,010,611

[45] Date of Patent: Apr. 30, 1991

[54] FITTED SAFETY CRIB SHEET WITH INTEGRAL BUMPER LINER

[76] Inventor: Sarah Mallett, Box 571, Jackson, N.H. 03846

[21] Appl. No.: 547,385

[22] Filed: Jun. 27, 1990

Related U.S. Application Data

[63] Continuation of Ser. No. 362,609, Jun. 7, 1989, abandoned.

[51] Int. Cl.[5] ..... A47G 9/04; A47C 27/08

[52] U.S. Cl. ..... 5/497; 5/424; 5/93.1

[58] Field of Search ..... 5/93 R, 424, 425, 496, 5/497, 508, 484

[56] References Cited

U.S. PATENT DOCUMENTS

| | | | |
|---|---|---|---|
| 949,389 | 2/1910 | Almgren | 5/93 R |
| 2,128,978 | 9/1938 | Akin | 5/93 R |
| 2,629,884 | 3/1953 | McMonagle | 5/348 |
| 2,637,047 | 5/1953 | Zurzolo | 5/320 |
| 3,018,492 | 1/1962 | Rosen | 5/93 R |
| 3,241,158 | 3/1966 | Berl | 5/93 R |
| 3,619,824 | 11/1971 | Doyle | 5/93 |
| 3,803,646 | 4/1974 | Newerowski | 5/345 |
| 4,525,883 | 7/1985 | Necowitz | 5/93 |
| 4,670,923 | 6/1987 | Gabriel | 5/424 |
| 4,754,509 | 7/1988 | Pollard | 5/425 |
| 4,800,600 | 1/1989 | Baum | 5/93 R |

FOREIGN PATENT DOCUMENTS

| | | | |
|---|---|---|---|
| 1272565 | 8/1961 | France | 5/508 |

*Primary Examiner*—Gary L. Smith
*Assistant Examiner*—F. Saether
*Attorney, Agent, or Firm*—Fish & Richardson

[57] ABSTRACT

A fitted fabric sheet for a mattress for a crib with vertical rails, the mattress having a top plane surface and vertical sides, has a peripheral edge coinciding with the vertical sides of the mattress, a fabric crib bumper liner with top and bottom edges, and e.g., ties or loops for securing the top edge of the bumper liner to the vertical crib rails. The bottom edge of the liner is secured along its entire length to the peripheral edge of the sheet.

5 Claims, 1 Drawing Sheet

FITTED SAFETY CRIB SHEET WITH INTEGRAL BUMPER LINER

This is a continuation of application Ser. No. 07/362,609, filed Jun. 7, 1989, now abandoned.

BACKGROUND OF THE INVENTION

The present invention relates to fitted fabric sheets for mattresses for use in infant cribs that have vertical side rails that extend above the mattress and keep the infant confined within the crib.

The fitted sheet of the invention is particularly useful in conjunction with a protective padded crib bumper that extends along the inside periphery of the crib side and end rails, and rests on the mattress to prevent the infant from bumping against the hard wood or metal rails that form the crib. Commercially available bumpers are ordinarily formed of elongated members, e.g. padded or of foam, secured end to end and arranged in a rectangle within the rails of the crib. Such bumpers are conventionally held in place by strings that extend from the bumper members and are tied to the side rails and occasionally to the head and foot boards or head and foot rails of the crib. The bumpers often are not very securely attached to the crib, and futhermore leave a gap between the bumper and mattress. Infants can therefore slip their limbs or head underneath the bumper and between adjacent rails. Such activity may injure the arms or legs of an infant, and could result in asphyxiation of the infant.

Addressing these problems, Doyle U.S. Pat. No. 3,619,824 describes a crib bumper with elongated members secured to a sheet that extends loosely between the lower edges of bumper. The sheet is preferably positioned beneath the mattress with its marginal areas adjacent to the bumper. In a further embodiment, each bumper element has its own sheet secured to the lower edge of the bumper and folded back on itself between the mattress and the side rails of the crib so as to form a pocket.

It is an objective of the present invention to provide a novel fitted sheet for a mattress for a crib that eliminates the difficulties and dangers noted above by cooperating in such a way with a crib bumper to prevent an infant from inserting its limbs or head between the bumper and mattress.

SUMMARY OF THE INVENTION

According to the invention, a novel fitted fabric sheet for a mattress for a crib with vertical rails, the mattress having a top plane surface and vertical sides including a peripheral edge that coincides with the vertical sides of the mattress, a fabric crib bumper liner with top and bottom edges, the bottom edge being secured along its entire length to the peripheral edge of the sheet, and means for securing the top edge of the bumper liner to the vertical rails of the crib.

Preferred embodiments of the invention may include one or more of the following features. In one embodiment, the bumper liner has the form of a fabric sleeve adapted to receive therein a crib bumper. In the first embodiment the bumper liner is formed of a single sheet of cloth that is secured at its bottom edge to the fitted sheet and at its top edge to the vertical rails of the crib, thereby keeping the bumper in place and preventing an infant from inserting a limb or its head between the bumper and mattress. In a further embodiment, the bumper liner has the form of a tubular sleeve for enclosing a crib bumper therewithin. Again, the top edge of this sleeve is secured to the crib rails, and the bottom edge is secured to the fitted sheet. In both embodiments, the fitted sheet with integral liner may be removed from the mattress and bumper for cleaning purposes. The sleeve embodiment may be designed so that the bumper may be removed, or so that it is permanently enclosed within the liner. Means for securing the upper edge of the bumper liner to the vertical rails of the crib are also provided, and may include tie strings or loops of string or fabric that correspond to securing means, e.g., hooks or slots on the vertical rails.

Other features and advantages of the invention will be apparent from the following description of the preferred embodiments thereof, and from the claims.

DESCRIPTION OF THE PREFERRED EMBODIMENTS

We first briefly described the drawings.

Figure 1:
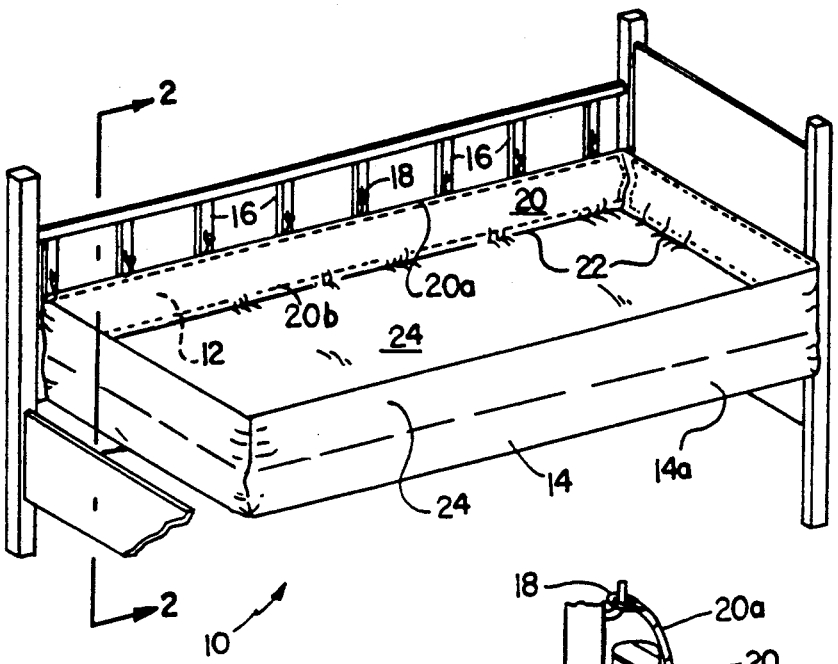
FIG. 1 is a perspective view of a fitted sheet with integral bumper liner of the invention as used in connection with a mattress, in a crib with vertical rails.

Referring to FIG. 1, a fitted safety sheet with integral bumper liner 1 of the invention is used in conjunction with a bumper 12, and a mattress 14. The crib is provided with vertical rails 16 with hooks 18 connected to each rail to provide a location where the top edge 20*a* of the bumper liner 20 can be secured. The bottom edge 20*b* of the bumper liner 20 is secured to the peripheral edge 22 of the fitted sheet 24 that coincides approximately with the side walls 14*a* of mattress 14. The bottom edge 20*b* of the bumper liner 20 is secured along its entire length to this peripheral edge 22 of the fitted sheet 24.

Figure 2:
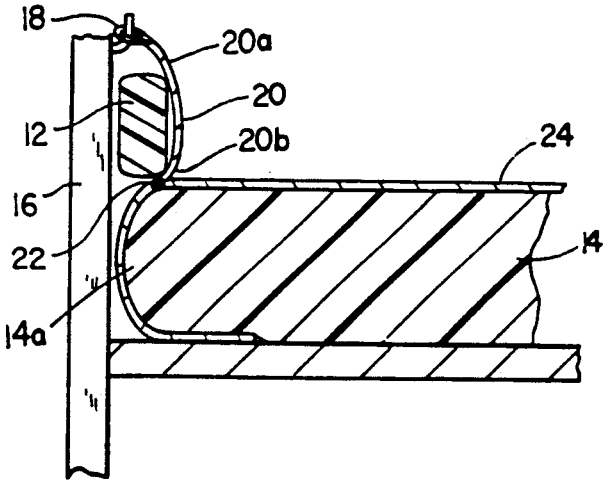
FIG. 2 is a cross sectional view taken along the line 2—2 of FIG. 1.

Referring now to FIG. 2, the lower edge 20*b* of the bumper liner 20 is physically attached to the fitted sheet at the peripheral edge 22. This attachment may be accomplished, e.g., by sewing, gluing, stapling or other conventional fastening techniques. This peripheral edge 22 coincides generally with the vertical sidewalls 14*a* of the mattress 14, that is, the peripheral edge 22 of the sheet 24 is located generally in the vicinity of the edge of the mattress. The top edge 20*a* of the bumper liner 20 is secured to hooks 18 located on the vertical rails 16. These hooks may be located on the inside or outside edges of the rails. As shown, the bumper liner 20 secures the bumper 12 in place, and restricts an infant from placing its limbs or head between the bumper and the mattress or between adjacent rails.

The fitted sheet 24 may be made of fabric such as cloth, waterproof cloth, plastic, or rubber. The term cloth is intended to encompass all woven or knitted material of natural or synthetic fibers. The crib bumper 12 is of a type typically made of a flexible resilient compressible inner material such as foam, rubber, or down that may be continuously covered with a sheet, e.g., a waterproof fabric or plastic material.

Figure 3:
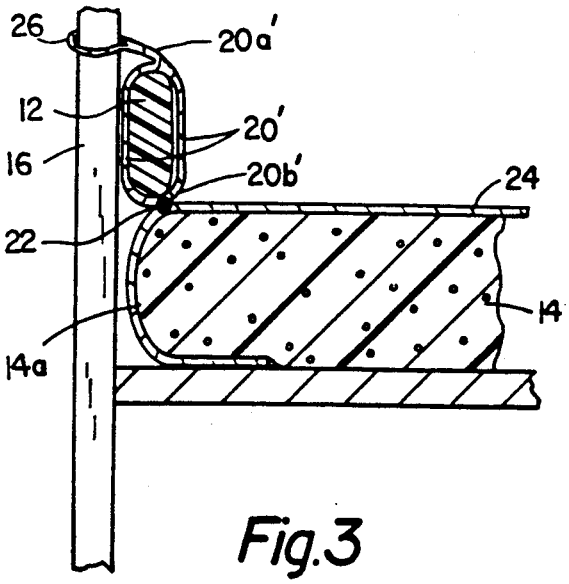
FIG. 3 is a view similar to that of FIG. 2, showing a second embodiment of the invention.

According to another embodiment of the invention, shown in FIG. 3, the bumper 12 is completely enclosed within a bumper sleeve 20′ that is again secured at its bottom edge 20*b*′ to the peripheral edge 22 of the fitted sheet 24. The top edge 20*a*′ of the bumper sleeve 20′ is secured to the vertical rails 16 by, e.g., string 26.

Figure 4:
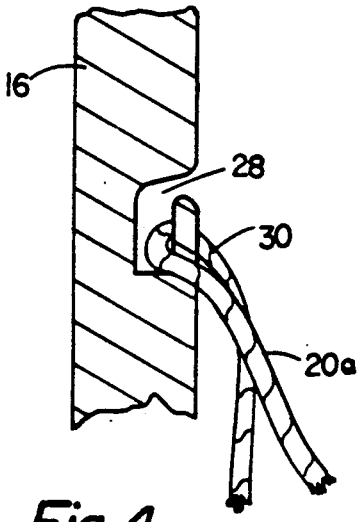
FIG. 4 is a cross sectional view of a vertical crib rail showing a further means of securing the bumper liner.

In FIG. 4., a vertical rail 16 has a slot 28 designed to receive a loop of string or material 30 inserted therein to secure the top edge 20*a*, 20′ of the bumper liner 20 or bumper sleeve 20′, respectively. This slot 28 is preferred to the hook 18 arrangement because of a reduced risk of injury to the infant should it come in contact with the hooks 18.

Other embodiments are within the following claims.

I claim:

1. A fitted sheet for a mattress for a crib with vertical rails, the mattress having a top plane surface and vertical sides, said sheet comprising a peripheral edge coinciding with the vertical sides of the mattress, and, integral with said sheet, a crib bumper liner with a top edge and a bottom edge, said bottom edge fixedly and permanently joined for its entire length to said peripheral edge of said sheet along an upper edge of the mattress in a manner to prevent a child from extending a limb between said bumper liner and said sheet, and means for securing the top edge of said bumper liner to the vertical rails of the crib, said integral sheet and crib bumper liner formed of a limp fabric material and adapted to be removed from a crib mattress for laundering.

2. The fitted sheet of claim 1, wherein said bumper liner comprises a fabric sleeve adapted to receive therein a crib bumper.

3. The fitted sheet of claim 2, wherein the bumper liner sleeve is constructed and intended for repeated removal and replacement of the crib bumper for laundering of said integral sheet and crib bumpef liner.

4. The fitted sheet of claim 1 or 2, wherein said means for securing the top edge of said bumper liner comprises a plurality of strings.

5. The fitted sheet of claim 1 or 2, wherein said means for securing the top edge of said bumper liner comprises a plurality of loops adapted for attachment to corresponding securing means on said vertical rails.

* * * * *

UNITED STATES PATENT AND TRADEMARK OFFICE

CERTIFICATE OF CORRECTION

PATENT NO. : 5,010,611

DATED : April 30, 1991

INVENTOR(S) : Sarah Mallett

It is certified that error appears in the above-identified patent and that said Letters Patent is hereby corrected as shown below:

Col. 1, line 63, insert --,-- after "embodiment".

Col. 2, line 31, "1" should be --10--.

Signed and Sealed this

Twenty-ninth Day of September, 1992

*Attest:*

DOUGLAS B. COMER

*Attesting Officer*

*Acting Commissioner of Patents and Trademarks*